US010487845B2

(12) United States Patent
Yang et al.

(10) Patent No.: US 10,487,845 B2
(45) Date of Patent: Nov. 26, 2019

(54) FAN STRUCTURE AND MANUFACTURING METHOD THEREOF

(71) Applicant: Quanta Computer Inc., Taoyuan (TW)

(72) Inventors: Chi-Hsueh Yang, Taoyuan (TW); Hsiao-Fan Chang, Taoyuan (TW)

(73) Assignee: Quanta Computer Inc., Taoyuan (TW)

( * ) Notice: Subject to any disclaimer, the term of this patent is extended or adjusted under 35 U.S.C. 154(b) by 331 days.

(21) Appl. No.: 15/440,421

(22) Filed: Feb. 23, 2017

(65) Prior Publication Data

US 2018/0112676 A1 Apr. 26, 2018

(30) Foreign Application Priority Data

Oct. 25, 2016 (TW) ..... 105134444 A

(51) Int. Cl.

| | |
|---|---|
| ***F04D 29/28*** | (2006.01) |
| ***F04D 29/30*** | (2006.01) |
| ***B21D 53/26*** | (2006.01) |
| ***B21D 22/02*** | (2006.01) |
| ***F04D 29/02*** | (2006.01) |
| *F04D 29/22* | (2006.01) |

(52) U.S. Cl.

CPC ..... *F04D 29/282* (2013.01); *B21D 22/02* (2013.01); *B21D 53/267* (2013.01); *F04D 29/023* (2013.01); *F04D 29/30* (2013.01); *F04D 29/2222* (2013.01)

(58) Field of Classification Search

CPC ..... F04D 29/282

See application file for complete search history.

(56) References Cited

U.S. PATENT DOCUMENTS

| | | | | |
|---|---|---|---|---|
| 1,700,017 | A * | 1/1929 | Bender | F04D 29/282 416/187 |
| 8,257,043 | B2 * | 9/2012 | Kuroki | F04D 29/282 416/186 R |
| 2007/0140842 | A1 * | 6/2007 | Hill | F04D 29/281 415/206 |
| 2016/0273546 | A1 * | 9/2016 | Chan | F04D 29/282 |
| 2016/0290355 | A1 * | 10/2016 | Lin | F04D 29/023 |
| 2017/0260984 | A1 * | 9/2017 | Xu | F04D 19/002 |
| 2017/0260994 | A1 * | 9/2017 | Xu | F04D 25/0606 |
| 2017/0260996 | A1 * | 9/2017 | Xu | F04D 29/281 |
| 2018/0238338 | A1 * | 8/2018 | Tamaoka | F04D 29/283 |
| 2019/0162201 | A1 * | 5/2019 | Huang | F04D 29/34 |

FOREIGN PATENT DOCUMENTS

| | | | |
|---|---|---|---|
| CN | 102762081 | A | 10/2012 |
| CN | 105545776 | A | 5/2016 |
| TW | 201035452 | A | 10/2010 |
| TW | M456682 | U | 7/2013 |
| TW | M492367 | U | 12/2014 |
| TW | M516103 | U | 1/2016 |

* cited by examiner

*Primary Examiner* — Hung Q Nguyen
*Assistant Examiner* — Mark L. Greene

(57) ABSTRACT

A fan structure includes a first fixing ring and a plurality of fan blades. The first fixing ring includes a plurality of first recesses radially arranged on the first fixing ring. One side of the fan blades is coupled to the first recesses of the first fixing ring. The first fixing ring includes a stamped part and a non-stamped part, in which the stamped part is in contact with the fan blades, and the thickness of the stamped part is smaller to the thickness of the non-stamped part.

11 Claims, 10 Drawing Sheets

FAN STRUCTURE AND MANUFACTURING METHOD THEREOF

CROSS-REFERENCE TO RELATED APPLICATION

This application claims priority to Taiwan Application Serial Number 105134444, filed Oct. 25, 2016, which is herein incorporated by reference.

BACKGROUND OF THE INVENTION

Field of Invention

The present disclosure relates to a fan structure and a manufacturing method thereof.

Description of Related Art

Electronic devices, such as computers and laptops, have their performance improved with the technology development. However, high processing speed of the electronic devices brings along with excessive thermal energy that affects the performance of the electronic devices. Typical plastic blades of a dissipating fan have limitation in heat dissipation due to the material properties and thickness of the blades. Metal blades may reduce the thickness of blades, and the performance of the fan may also be improved. However, the fabrication of metal fan structures exist many challenges. Thus, a structure and a manufacturing method for simplifying and improving the strength of fan structures are needed.

SUMMARY OF THE INVENTION

An embodiment of the present disclosure provides a fan structure a first fixing ring including a plurality of first recesses radially arranged on the first fixing ring; a plurality of blades, one side of the blades is coupled to the first recesses, wherein the first fixing ring includes a stamped part and a non-stamped part, and the stamped part is thinner than the non-stamped part.

Another embodiment of the present disclosure provides a method for manufacturing a fan structure, including placing a plurality of blades into a plurality of first recesses of a first fixing ring, wherein each of the blades and the each of the corresponding first recesses include a gap therebetween; and stamping the first fixing ring, such that a material of the first fixing ring is squeezed and extends into the gap to fix the blades.

The present disclosure provides a fan structure and a manufacturing method thereof. A plurality of blades are placed into a recess of a fixing ring and followed with a stamping process, such that the fan structure with thin blade may be able to achieve. In addition, through the stamping process, the manufacturing process may be simplified, and the strength of the fan structure may also be improved.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
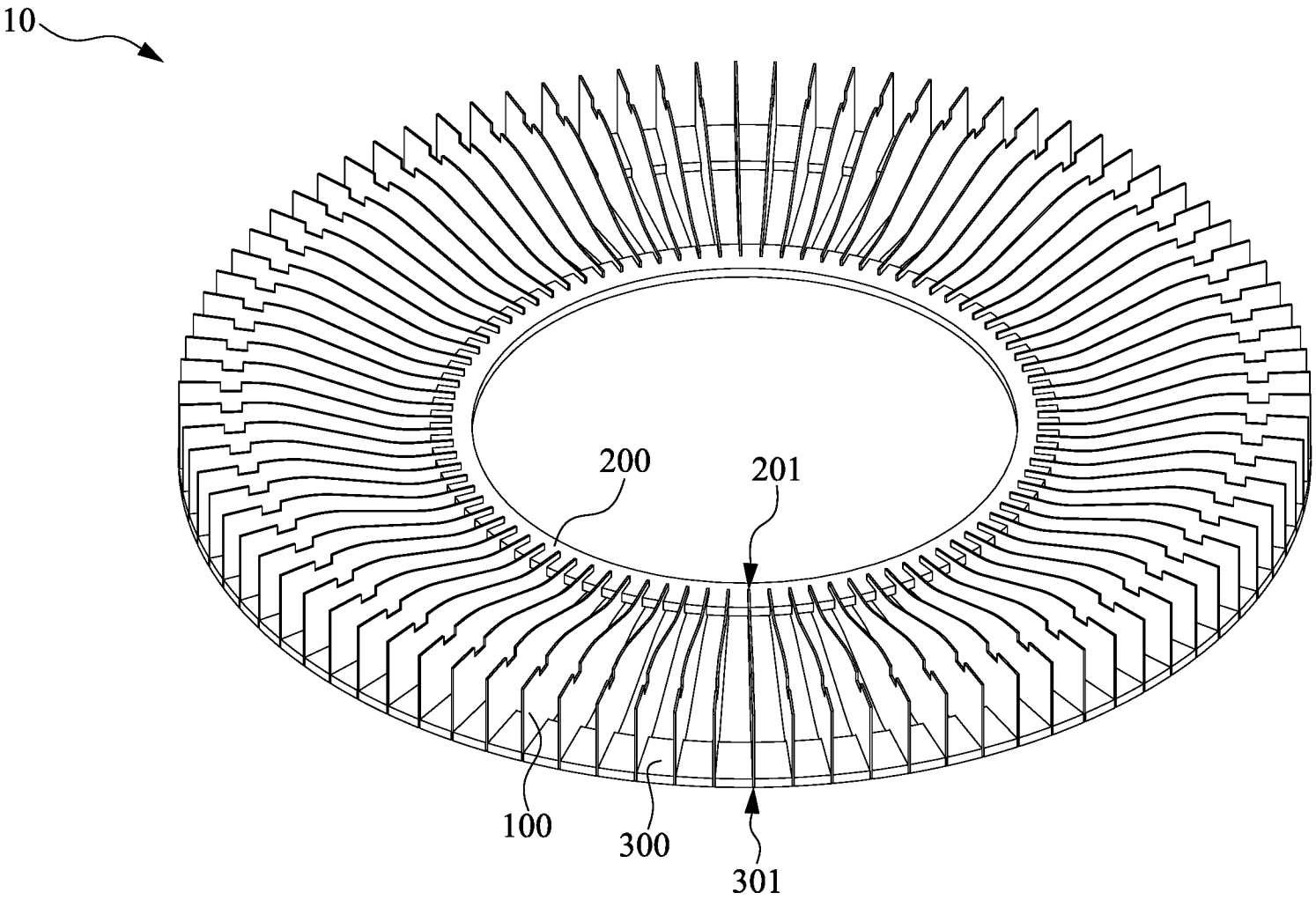
FIGS. 1A and 1B are perspective view and top view of a fan structure according to some embodiments of the present disclosure, respectively.

Reference will now be made in detail to the present embodiments of the invention, examples of which are illustrated in the accompanying drawings. Wherever possible, the same reference numbers are used in the drawings and the description to refer to the same or like parts.

Figure 1B:
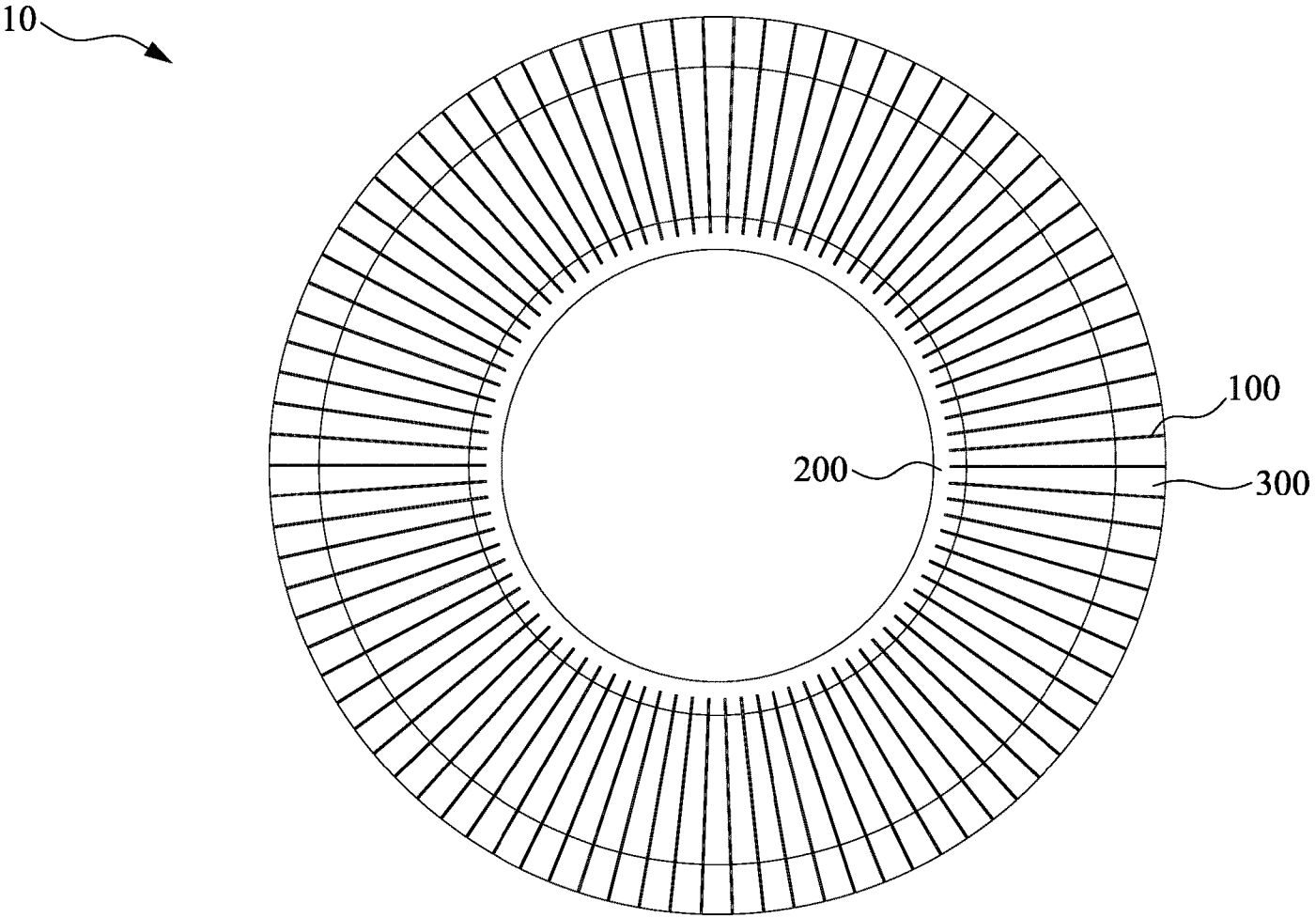

FIGS. 1A and 1B are perspective view and top view of a fan structure according to some embodiments of the present disclosure, respectively. A fan structure 10 includes a plurality of blades 100, a first fixing ring 200, and a second fixing ring 300. The first fixing ring 200 and the second fixing ring 300 are circles with identical center, in which a diameter of the first fixing ring 200 is smaller than that of the second fixing ring 300. A plurality of first recesses 201 with same spacing therebetween are radially arranged on the circumference of the first fixing ring 200. Similarly, a plurality of second recesses 301 with same spacing therebetween are radially arranged on the circumference of the second fixing ring 300. One side of the blades is coupled to the first recesses 201 of the first fixing ring 200, and another side the blades is coupled to the second recesses 301 of the second fixing ring 300. In some embodiments, the numbers of the blades, the first recesses 201, and the second recesses 301 are the same. In some other embodiments, the second fixing ring 300 may be omitted.

The blades 100, first fixing ring 200, and the second fixing ring 300 are made of malleable materials. In some embodiments, the blades 100, first fixing ring 200, and the second fixing ring 300 are made of metals, such as stainless steels (alloy of iron), Cu, Al, or other suitable metals. The blades 100, first fixing ring 200, and the second fixing ring 300 may be made of same material or different materials. In some embodiments, the malleability of blades 100 is smaller than the malleability of the first fixing ring 200 and the second fixing ring 300.

In FIG. 1B, the blades 100 are straight, and are radially arranged on the circumferences of the first fixing ring 200 and the second fixing ring 300. In detail, the blades 100 are respectively perpendicular (i.e. 90 degree) to a corresponding one of the tangent lines of the circumferences of the first fixing ring 200 and the second fixing ring 300. From another view, the blades 100 are arranged along with the radii of the first fixing ring 200 and the second fixing ring 300, but the present disclosure are not limited thereto. Since the blades 100 are made of malleable materials, the thickness of the blades 100 may be very thin. In some embodiments, the thickness of the blades 100 ranges from 0.05 mm to 0.1 mm.

Figure 2A:
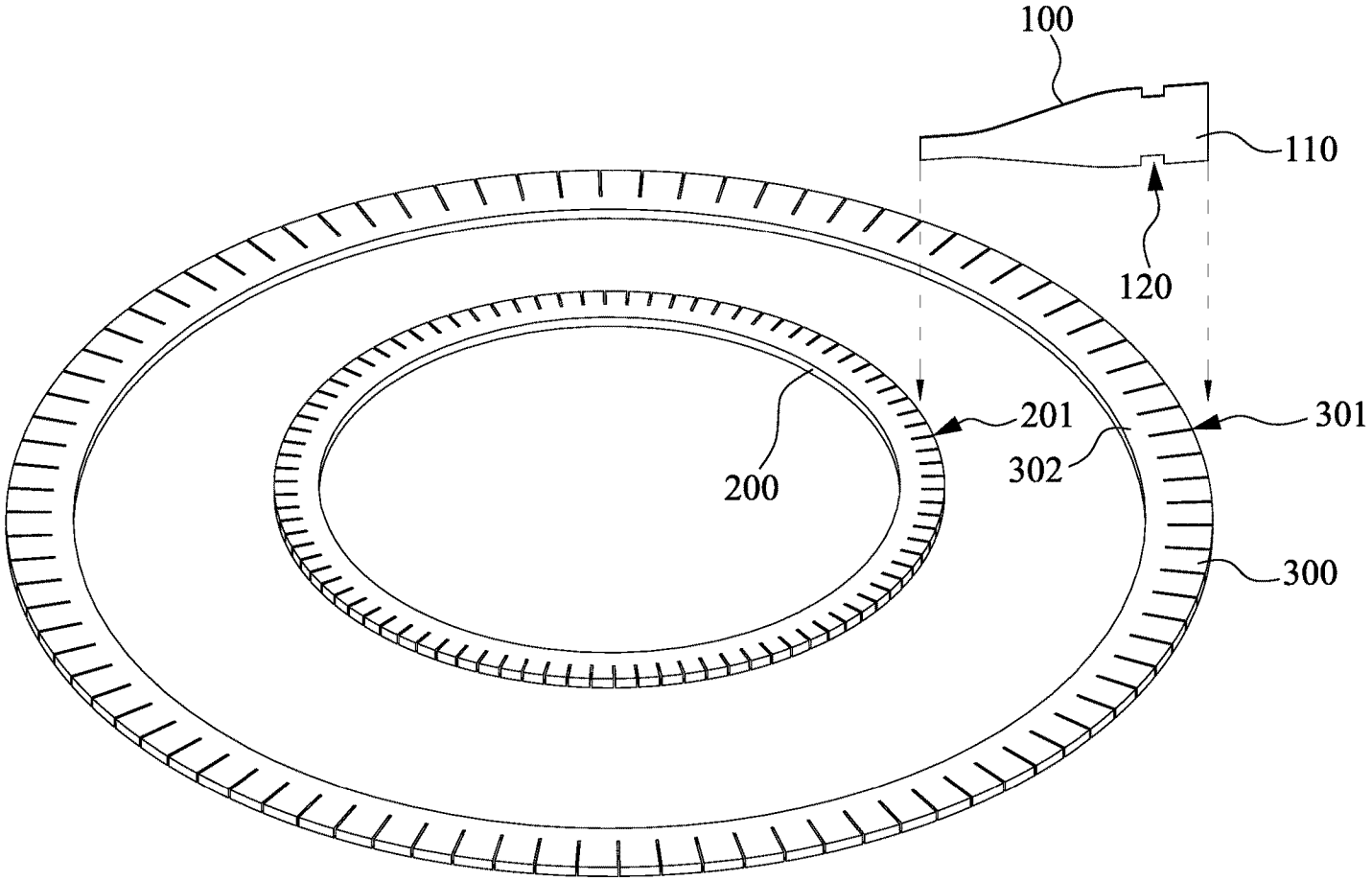
FIGS. 2A and 2B are schematic view of assembling a fan structure according to some embodiments of the present disclosure.
Figure 2B:
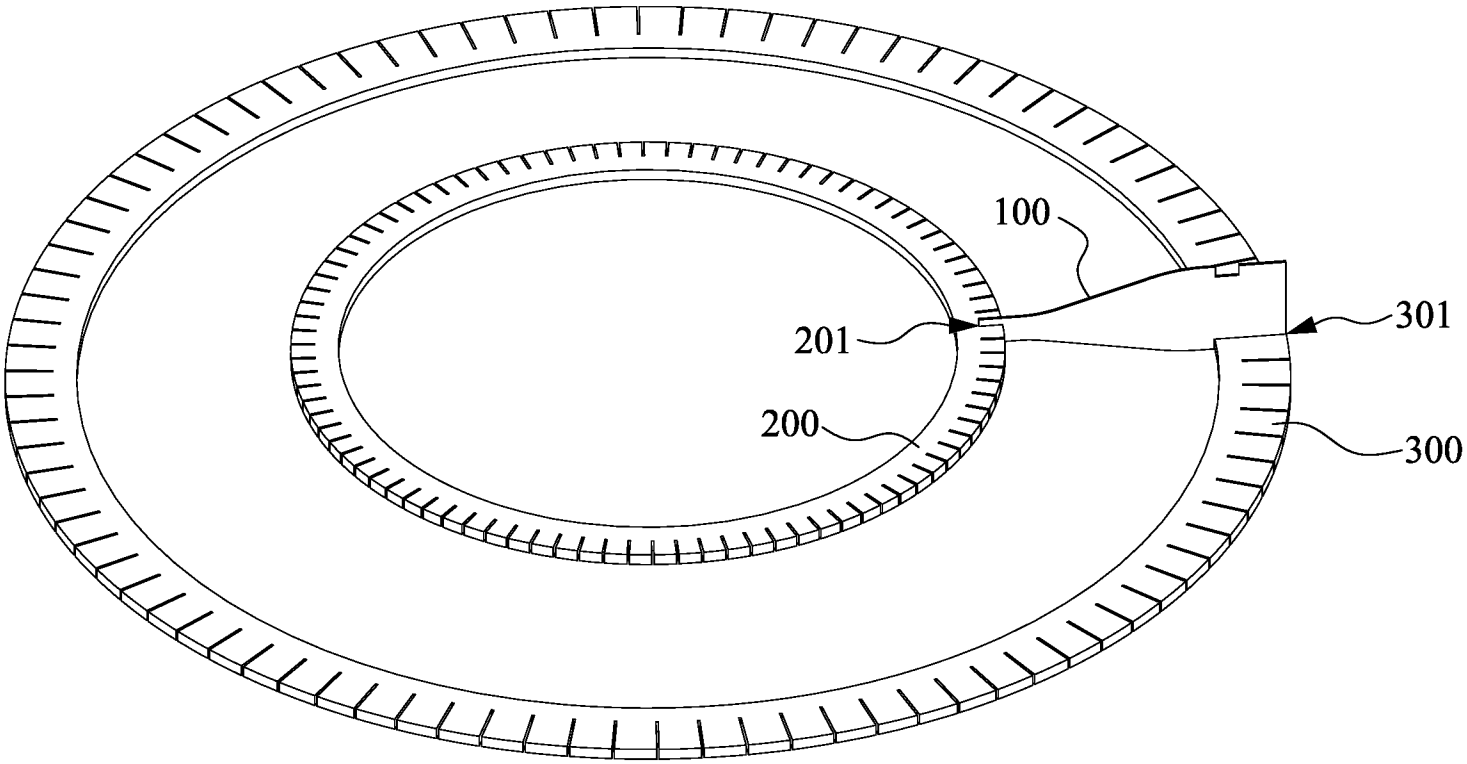

FIGS. 2A and 2B are schematic view of assembling a fan structure according to some embodiments of the present disclosure. In FIG. 2, a first fixing ring 200 and a second fixing ring 300 are provided. The first fixing ring 200 includes a plurality of first recesses 201 arranged along the circumference of the first fixing ring 200. The second fixing ring 300 includes a plurality of second recesses 301 arranged along the circumference of the second fixing ring 300. In this embodiment, the number of the first recesses 201 is equal to the number of the second recesses 301, and each of the first recesses 201 corresponds to each of the second recesses 301. The first recesses 201 and the second recesses 301 may be formed by recessing the first fixing ring 200 and the second fixing ring 300 through stamping or forging. In the present embodiments, the first recesses 201 and the second recesses 301 are vertically penetrate through the first fixing ring 200 and the second fixing ring 300, respectively, but the present disclosure is not limited thereto.

Subsequently, a plurality of blades 100 are provided. One side of the blades 100 corresponds to the first recesses 201, and another side of the blades 100 corresponds to the second recesses 301. In the present embodiment, the first recesses 201 and second recesses 301 are arranged on the outer side of the circumferences of the first fixing ring 200 and the second fixing ring 300, respectively. One side of the blades 100 is engaged into the first recesses 201. In addition, another side the blades 100, which is close to the second fixing ring 300, has at least one notches 120 and at least one protrusion part 110. The protrusion part 110 is engaged into the one of the second recesses 301 disposed on the outer side of the circumference of the second fixing ring 300. On the other hand, a portion 302 of the inner side of the second fixing ring 300 (the side without the second recesses 301) is engaged into the notch 102.

In the present embodiment, the shape of the blades 100 is a gradual structure, in which the size of the blades 100 increases from the first fixing ring 200 to the second fixing ring 300. It should be understood that the shapes and the positions of the blades 100, the first recesses 201, and the second recesses 301 may be modified according to desired design. For example, in some other embodiments, the second recesses 301 may be arranged on the inner side of the circumference the second fixing ring 300, and the protrusion part 100 of the blades 100 may be omitted.

In FIG. 2, the blades 100 are placed into the first recesses 201 and the corresponding second recesses 301. In the present embodiment, since the first recesses 201 and the second recesses 301 are respectively perpendicular to a corresponding one of the tangent lines of the circumferences of the first fixing ring 200 and the second fixing ring 300, the length direction of the blades 100 is also perpendicular to a corresponding one of the tangent lines of the circumferences of the first fixing ring 200 and the second fixing ring 300. Accordingly, the blades 100 may be directly placed into the first recesses 201 and the second recesses 301 without bending. That is, the blades 100 are arranged along the radii of the first fixing ring 200 and the second fixing ring 300. It should be understood that only one blade 100 shown in FIG. 2 is merely used for explanation. In practice, people skilled in this art may place the blades 100 into the recesses 201, 301 in sequence, or may place all of the blades 100 into the recesses 201, 301 at one time by jigs.

Figure 3A:
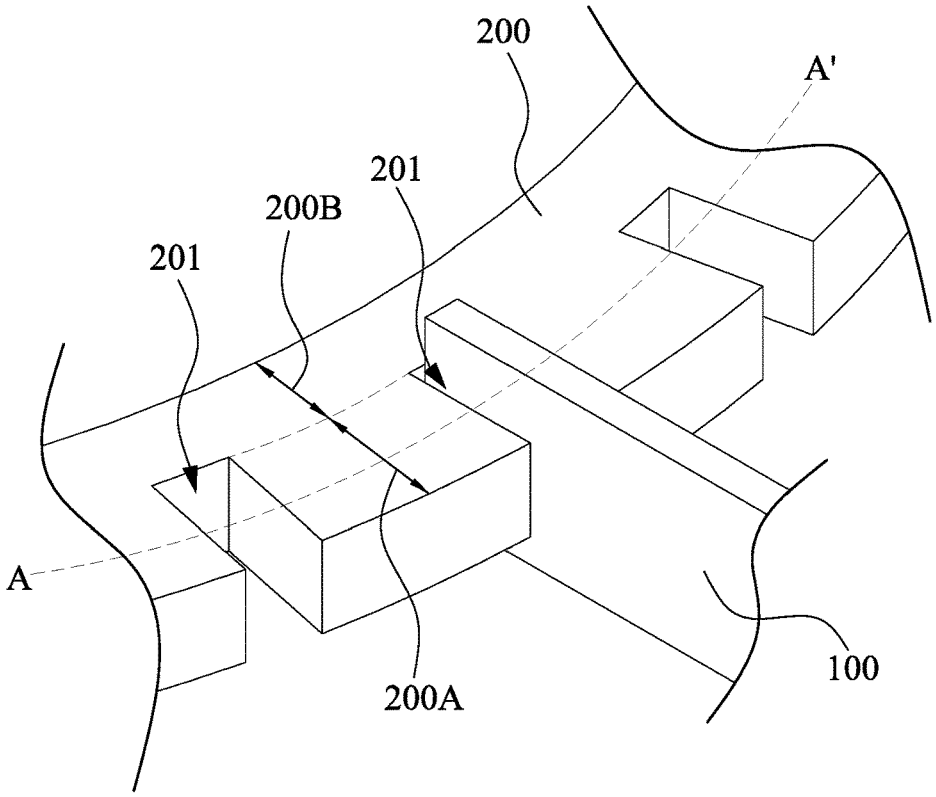
FIGS. 3A and 3B are partially perspective view and sectional view of a fan structure according to some embodiments of the present disclosure, respectively.
Figure 3B:
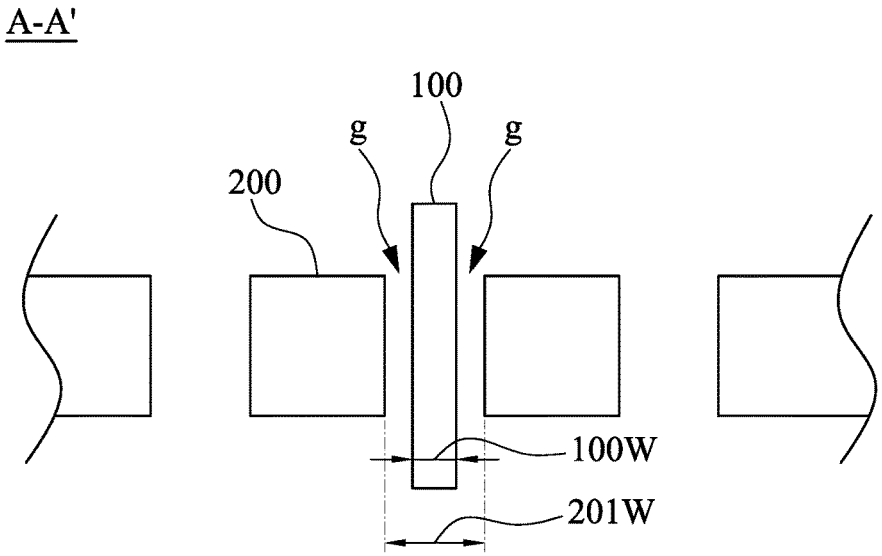

FIGS. 3A and 3B are partially perspective view and sectional view of a fan structure according to some embodiments of the present disclosure, respectively. FIG. 3A is a perspective view in that a blade 100 is placed into a first recess 201 of a first fixing ring 200. FIG. 3B is a sectional view along line A-A' of FIG. 3A. In the present embodiment, the first recess 201 vertically penetrates through the first fixing ring 200. In some other embodiments, the first recess 201 may partially penetrate through the first fixing ring 200. In addition, the height of the blade 100 is slightly larger than the height of the first recess 201 (the height of the first fixing ring 200), but the present disclosure is not limited thereto. In practice, people skilled in this art may design profiles, shapes, and sizes of blades and recesses according to requirements.

In FIG. 3A, the first fixing ring 200 may be separated into an outer ring 200A and an inner ring 200B, in which the boundary between the outer ring 200A and the inner ring 200B is the end of the first recess 201. That is, the outer ring 200A is a part including the first recesses 201, but the inner ring 200B is a part without the first recesses 201.

In FIG. 3B, the blade 100 has a width 100W, and the first recess 201 has a width 201W. In some embodiments, the width 100W of the blade 100 ranges from about 0.05 mm to about 0.1 mm. In addition, the width 201W of the first recess 201 is slightly larger than the width 100W of the blade 100. Therefore, the blade 100 may be easily placed into the first recess 201 in assembling step. Accordingly, after the blade 100 is placed into the first recess 201, the blade 100 and the first recess 201 includes a gap g therebetween.

Figure 4A:
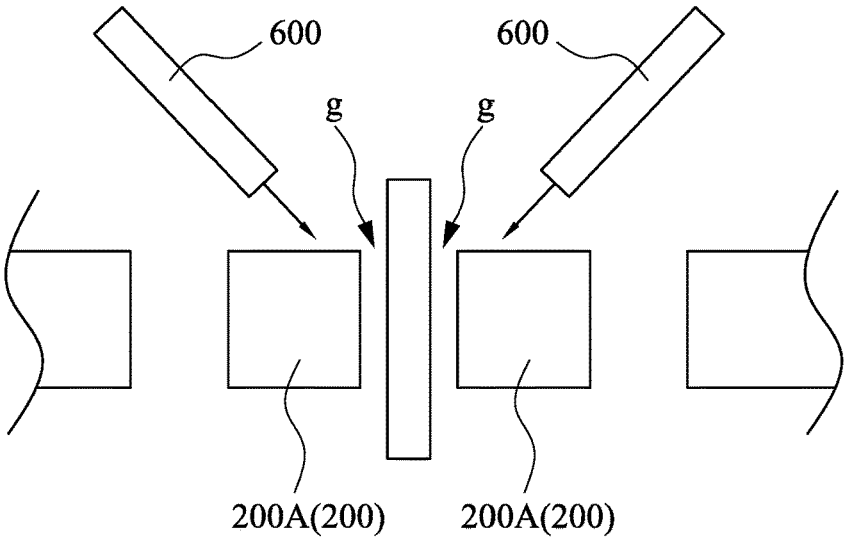
FIG. 4A is a sectional view of a method of manufacturing a fan structure according to some embodiments of the present disclosure.
Figure 4B:
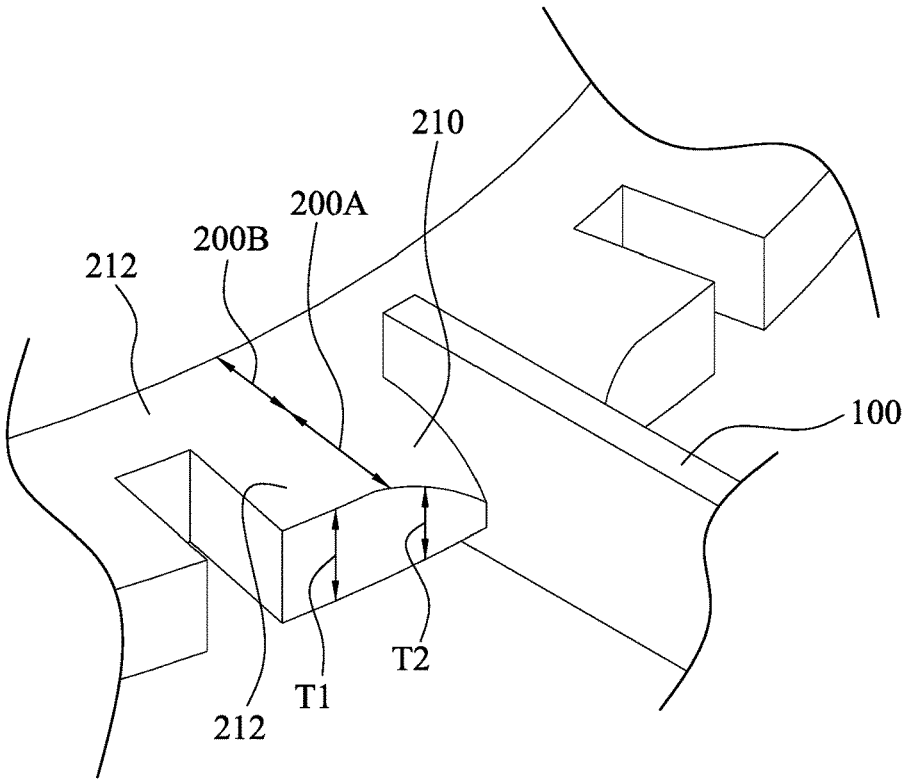
FIG. 4B is a perspective view of fan structure formed by the method of FIG. 4A.

FIG. 4A is a sectional view of a method of manufacturing a fan structure according to some embodiments of the present disclosure. FIG. 4B is a perspective view of fan structure formed by the method of FIG. 4A. In FIG. 4A, the top surface of the outer ring 200A of the first fixing ring 200 (as shown in FIG. 3A) near the blade 100 is stamped. It should be noted that FIG. 4A only shows one blade 100 and the first ring 200 at the opposite side of the blade 100. In practice, all of the blades 100 and first fixing ring 200 may be stamped simultaneously. In some embodiments, the stamping process may include placing a fan structure 10 (as shown in FIG. 1A) on a stamping substrate, and stamping the top surface of the first fixing ring 200 with a stamping tool 600. In the present embodiment, the stamping tool 600 is applied to a part of the outer ring 200A near the blade 100. Since the first fixing ring 200 is made of malleable materials, the gap g between the blade 100 and the first recess 201 may be filled through the extension of the stamped materials after stamping. Accordingly, all of the blades 100 are tightly combined with the first fixing ring 200.

In some embodiment, the blades 100 and the first fixing ring 200 may be metals, such as stainless steels (alloy of iron), Cu, Al, or other suitable metals. The blades 100 and the first fixing ring 200 may be made of same material or different materials. In some embodiments, the malleability of blades 100 is smaller than the malleability of the first fixing ring 200. That is, the hardness of the blades 100 is larger than that of the first fixing ring 200. Therefore, the blades 100 with larger hardness (or lower malleability) are hard to be deformed during the stamping process.

FIG. 4B is a perspective view of fan structure formed by the method of FIG. 4A. The stamped first fixing ring 200 may be separated into a stamped part 210 and a non-stamped part 212. In the present embodiment, only the part of the outer ring 200A near the blades 100 are stamped, such that the stamped part 210 is substantially equal to the part of the outer ring 200A near the blades 100, and the non-stamped part 212 includes the inner ring 200B and another part the outer ring 200A. The stamped part 210 is squeezed by the stamping tool, and extending toward the blades 100 and further filling the gap g (as shown in FIG. 4A). The stamped part 210 is in contact with the blades 100. Therefore, the blades 100 are tightly fixed, and the overall structure is stable and balanced.

Moreover, due to squeeze, the stamped part 210 has a shrunk profile. Overall, the thickness T2 of the stamped part 210 is smaller than the thickness T1 of the non-stamped part 212, in which the thickness T1 is also equal to the thickness of the first fixing ring 200 without stamped. It should be noted that the profile of the stamped part 210 described herein is merely used to explain. In practice, the profile of the stamped part 210 may vary according to the operating situation, such as the shape of molding tools or the strength of stamping.

Figure 5A:
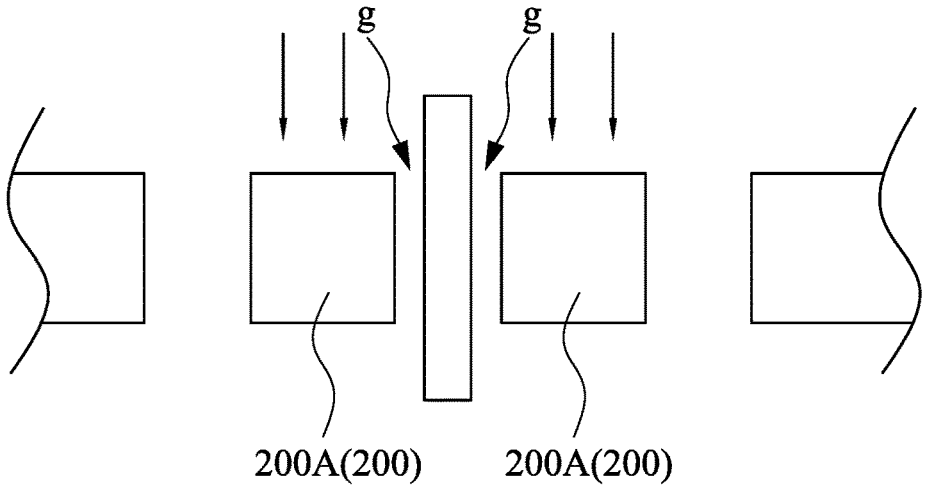
FIG. 5A is a sectional view of a method of manufacturing a fan structure according to some embodiments of the present disclosure.
Figure 5B:
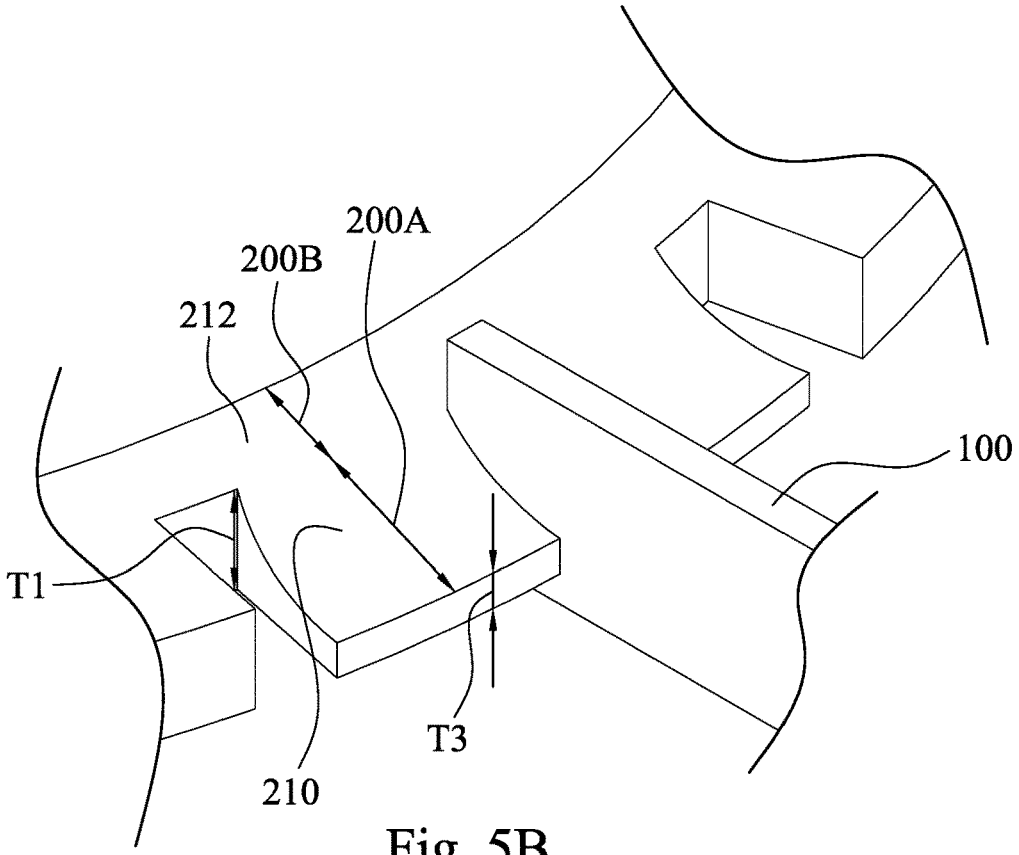
FIG. 5B is a perspective view of fan structure formed by the method of FIG. 5A.

FIG. 5A is a sectional view of a method of manufacturing a fan structure according to some embodiments of the present disclosure. FIG. 5B is a perspective view of fan structure formed by the method of FIG. 5A. FIGS. 5A and 5B are similar to FIGS. 4A and 4B. Some details are omitted for simplification. FIG. 5A differs from FIG. 4A, in that the stamping process of FIG. 5A includes stamping the top surface of the outer ring 200A (as shown in FIG. 3A) of the first fixing ring 200. It should be noted that FIG. 5A only shows one blade 100 and the first ring 200 at the opposite side of the blade 100. In practice, all of the blades 100 and first fixing ring 200 may be stamped simultaneously. Since the first fixing ring 200 is made of malleable materials, the gap g between the blade 100 and the first recess 201 may be filled through the extension of the stamped materials after stamping. Accordingly, all of the blades 100 are tightly combined with the first fixing ring 200.

In some embodiment, the blades 100 and the first fixing ring 200 may be metals, such as stainless steels (alloy of iron), Cu, Al, or other suitable metals. The blades 100 and the first fixing ring 200 may be made of same material or different materials. In some embodiments, the malleability of blades 100 is smaller than the malleability of the first fixing ring 200. That is, the hardness of the blades 100 is larger than that of the first fixing ring 200. Therefore, the blades 100 with larger hardness (or lower malleability) are hard to be deformed during the stamping process.

FIG. 5B is a perspective view of fan structure formed by the method of FIG. 5A. The stamped first fixing ring 200 may be separated into a stamped part 210 and a non-stamped part 212. In the present embodiment, the overall surface of the outer ring 200A near the blades 100 are stamped, such that the stamped part 210 is substantially equal to the outer ring 200A, and the non-stamped part 212 is substantially equal to the inner ring 200B. The stamped part 210 is squeezed by the stamping tool, extending toward the blades 100 and further filling the gap g (as shown in FIG. 5A). The stamped part 210 is in contact with the blades 100. Therefore, the blades 100 are tightly fixed, and the overall structure is stable and balanced.

Moreover, due to squeeze, the stamped part 210 has a shrunk profile. Overall, the thickness T3 of the stamped part 210 is smaller than the thickness T1 of the non-stamped part 212, in which the thickness T1 is also equal to the thickness of the first fixing ring 200 without stamped. It should be noted that the profile of the stamped part 210 described herein is merely used to explain. In practice, the profile of the stamped part 210 may vary according to the operating situation, such as the shape of molding tools or the strength of stamping.

In some other embodiments, the stamping process includes stamping the overall surface of the first fixing ring. That is, both the outer ring 200A and the inner ring 200B are stamped. Thus, the stamped part is substantially equal to the overall first fixing ring. Since the stamping process is applied to the overall surface of the first fixing ring 200, the overall thickness of the first fixing ring are substantially the same after stamping. In addition, the shrunk thickness is smaller than the thickness of the original first fixing ring before stamping process.

The above description only show the stamping method between the blades 100 and the first fixing ring 200, but the disclosure is not limited thereto. Similar method or different method may also be applied to the blades 100 and other rings (i.e. the second fixing ring 300).

Figure 6:
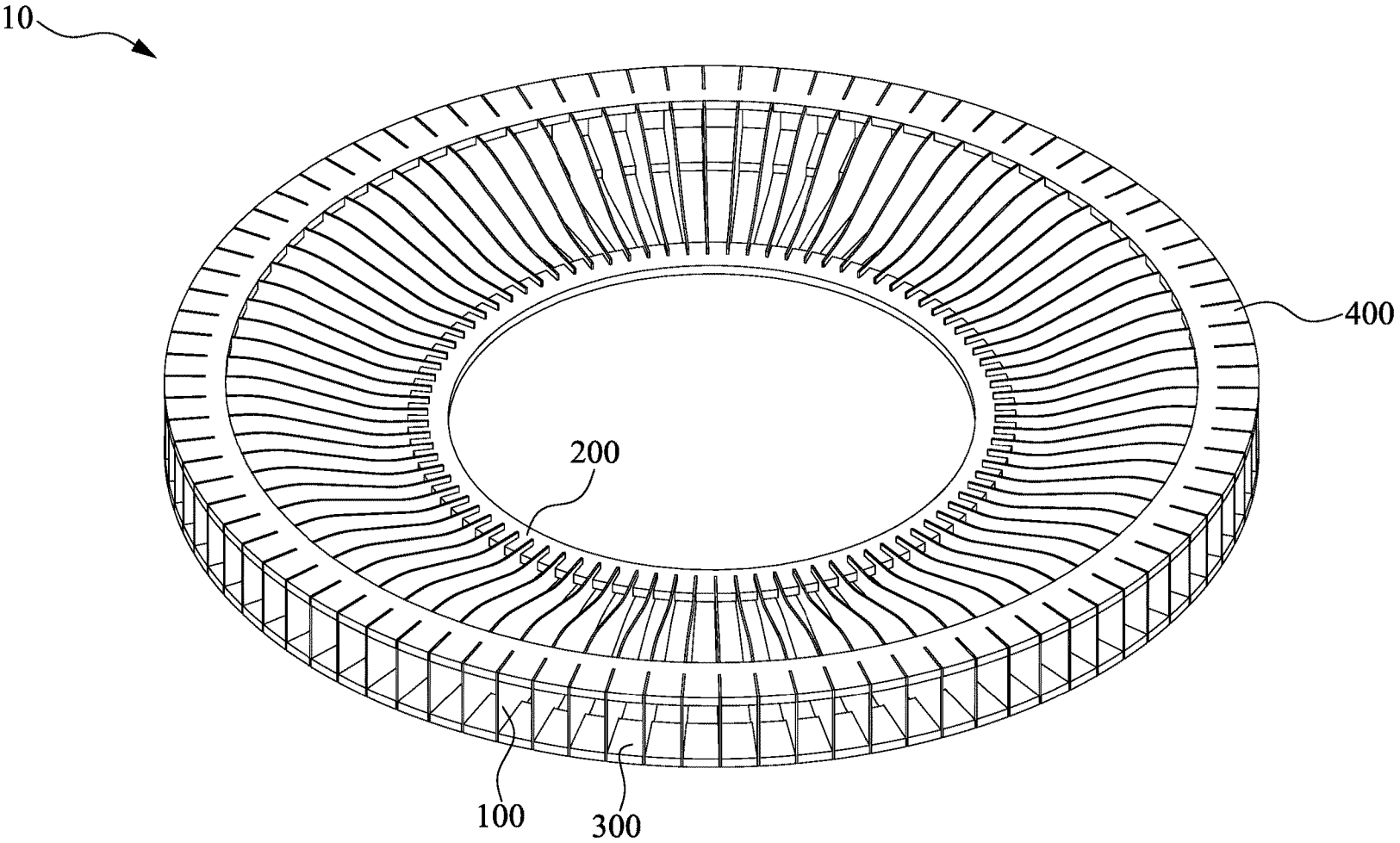
FIG. 6 is a perspective view of a fan structure according to some embodiments of the present disclosure.

FIG. 6 is a perspective view of a fan structure according to some embodiments of the present disclosure. The fan structure 10 further includes a third fixing ring 400. In the present embodiment, the third fixing ring 400 may be equal to the second fixing ring 300 in structure. Moreover, the blades 100 have symmetric profile, in which each of the blades 100 includes two notches 120 and two protrusion part 110 disposed oppositely. Thus, the third fixing ring 400 may be disposed on another side of the blades 100 opposite to the second fixing ring 300 with similar method described in FIGS. 2A and 2B. Such design may improve the overall strength of the fan structure.

Figure 7:
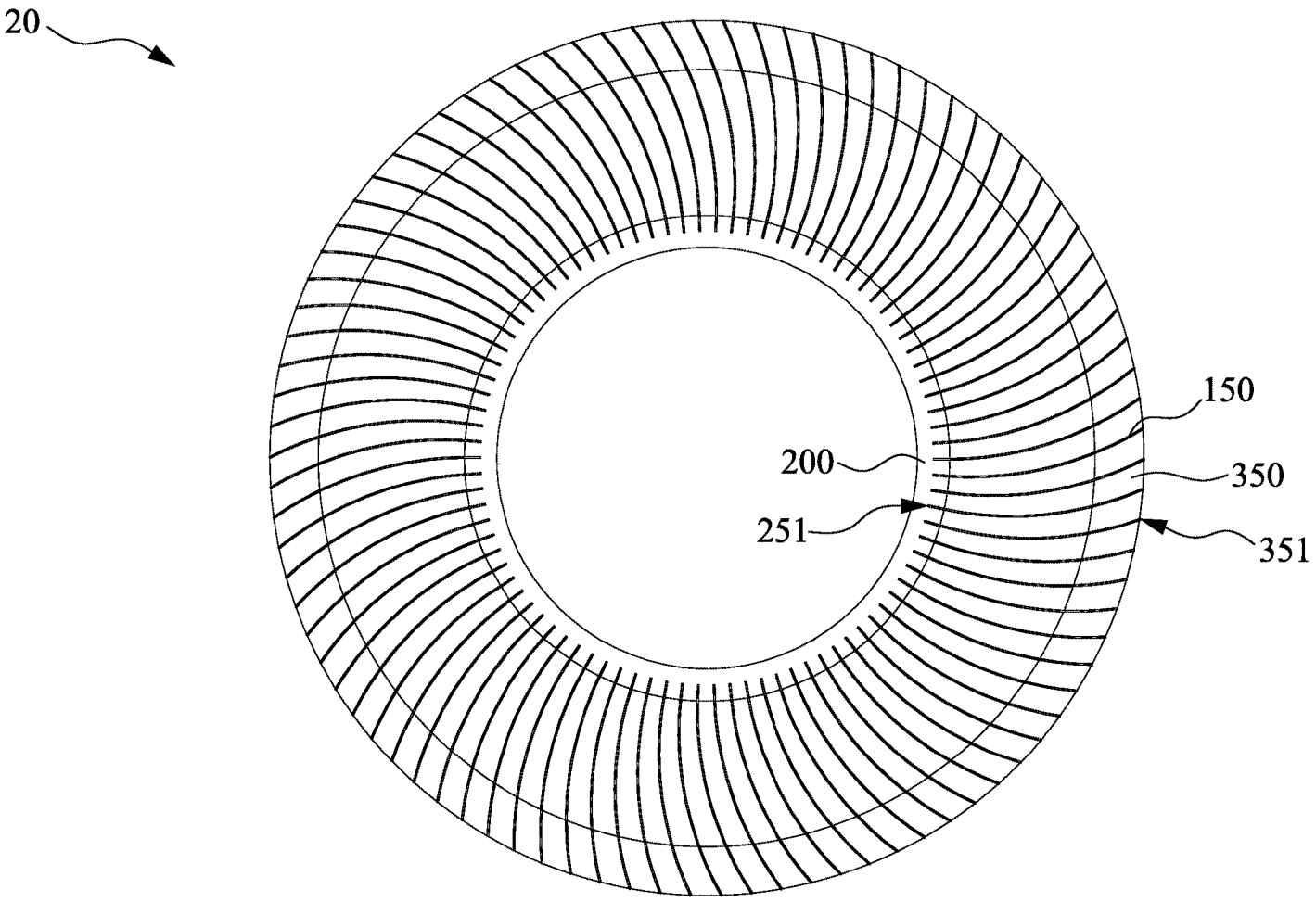
FIG. 7 is a top view of a fan structure according to some embodiments of the present disclosure.

FIG. 7 is a top view of a fan structure according to some embodiments of the present disclosure. Similar to FIG. 1B, a fan structure 20 includes a first fixing ring 250, a second fixing ring 350, and a plurality of blades 150. The first fixing ring 250 includes a plurality of first recesses 251 radially arranged on the circumference of the first fixing ring 250, and the second fixing ring 350 includes a plurality of second recesses 351 radially arranged on the circumference of the second fixing ring 350, in which each of the first recesses 251 corresponds to each of the second recesses 351. In the present embodiment, the second recesses 351 are not perpendicular to a corresponding one of the tangent line of the circumference of the second fixing ring 350. Since the thin blades 150 (i.e. about 0.05 mm to about 0.1 mm) are made of malleable materials, the blades 150 may be bent into an arc shape for engaging into the first recesses 251 and the corresponding second recesses 351.

Figure 8:
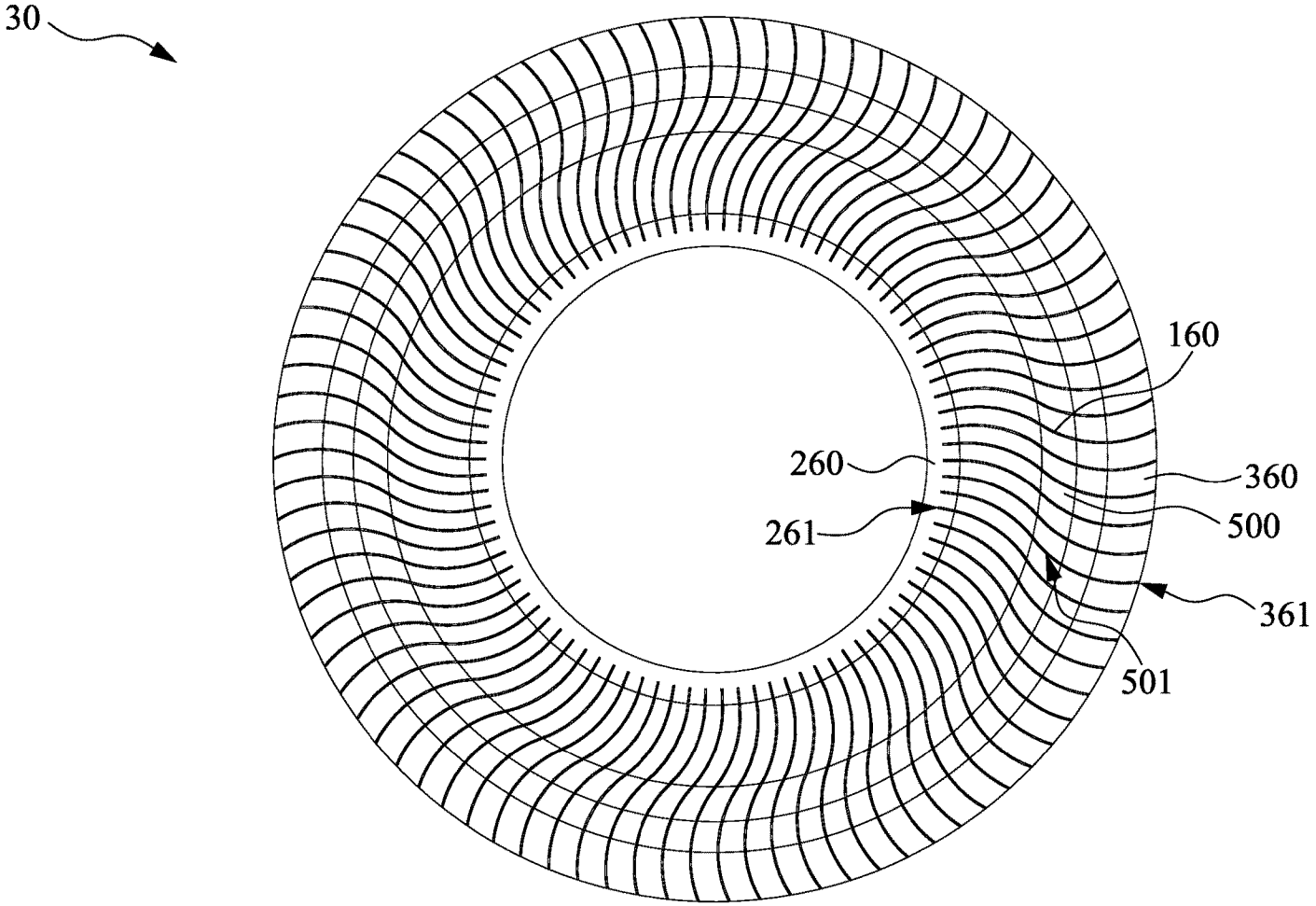
FIG. 8 is a top view of a fan structure according to some embodiments of the present disclosure.

FIG. 8 is a top view of a fan structure according to some embodiments of the present disclosure. Similar to FIG. 1B, a fan structure 30 includes a first fixing ring 260, a second fixing ring 360, and a plurality of blades 160. The first fixing ring 260 includes a plurality of first recesses 261 radially arranged on the circumference of the first fixing ring 260, and the second fixing ring 360 includes a plurality of second recesses 361 radially arranged on the circumference of the second fixing ring 360, in which each of the first recesses 261 corresponds to each of the second recesses 361. In the present embodiment, the second recesses 361 are not perpendicular to a corresponding one of the tangent line of the circumference of the second fixing ring 361. The present disclosure provides a fan structure and a manufacturing method thereof. A plurality of blades are placed into recesses of a fixing ring. Through a stamping process, a fan structure with thin blade may be able to achieve. In addition, through the stamping process, the manufacturing process may be simplified, and the strength of the fan structure may also be improved. In the present disclosure, the fan structure 30 further includes a third fixing ring 500 disposed between the first fixing ring 260 and the second fixing ring 360. Accordingly, the third fixing ring 500 is larger than the first fixing ring 260 and is smaller than the second fixing ring 360. The third fixing ring 500 has a plurality of third recesses 501. The third recesses 501 may be designed in an inflection shape, such that the blades 160 engaged in the third recesses 501 may be reversely bent. Thus, the blades 160 may be bent into a wave-like shape through the first fixing ring 260, the second fixing ring 360, and the third fixing ring 500. In the present disclosure, the third fixing ring 500 may be applied to reversely bend the blades, and the strength of the fan structure 30 may also be improved by the third fixing ring 500.

The present disclosure provides a fan structure and a manufacturing method thereof. A plurality of blades are placed into a recess of a fixing ring and followed with a stamping process, such that the fan structure with thin blade may be able to achieve. In addition, through the stamping process, the manufacturing process may be simplified, and the strength of the fan structure may also be improved.

It should be noted that the number of the fixing rings, the number of the recesses, the shape of the recesses, the shaped of the blades, and the material described above are merely used to explain, and are not going to limited the present disclosure. In practice, people skilled in this art may design different fan structures according to requirements.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A fan structure, comprising:

a first fixing ring comprising a plurality of first recesses radially arranged on the first fixing ring;

a plurality of blades, one side of each of the blades being coupled to the first recesses, wherein the first fixing ring comprises a stamped part and a non-stamped part, and the stamped part is thinner than the non-stamped part;

a second fixing ring comprising a plurality of second recesses radially arranged on the second fixing ring, and the second fixing ring being larger than the first fixing ring, wherein another side of each of the blades is coupled to the second recesses; and a third fixing ring disposed between the first fixing ring and the second fixing ring, wherein the third fixing ring comprises a plurality of third recesses, and the blades are coupled to the third recesses.

2. The fan structure of claim 1, wherein the stamped part has a shrunk profile.

3. The fan structure of claim 1, wherein the first fixing ring is separated into an outer ring having the first recesses disposed thereon and an inner ring without the first recesses, wherein:

the stamped part is a part of the outer ring close to the blades.

4. The fan structure of claim 1, wherein the first fixing ring is separated into an outer ring having the first recesses disposed thereon and an inner ring without the first recesses, wherein:

the stamped part is the outer ring.

5. The fan structure of claim 1, wherein the first fixing ring is made of malleable materials.

6. The fan structure of claim 1, wherein a thickness of the blades ranges from 0.05 mm to 0.1 mm.

7. The fan structure of claim 1, wherein the first recesses and the second recesses are respectively perpendicular to corresponding tangent lines of the circumferences of the first fixing ring and the second fixing ring, and the blades are respectively perpendicular to the corresponding tangent lines of the circumferences of the first fixing ring and the second fixing ring.

8. The fan structure of claim 1, wherein the first recesses are respectively perpendicular to a corresponding one of the tangent lines of the circumferences of the first fixing ring, but the second recesses are not perpendicular to the second fixing ring, and the blades are coupled to the first fixing ring and the second fixing ring with an arc shape.

9. The fan structure of claim 1, wherein the another side of the blades comprises at least one protrusion part and at least one notch for being coupled to the second fixing ring.

10. The fan structure of claim 1, wherein the third recesses comprise an inflection shape, and the blades coupled to the third recesses have a wave-like shape.

11. A fan structure, comprising:

a first fixing ring comprising a plurality of first recesses radially arranged on the first fixing ring;

a plurality of blades, one side of each of the blades being coupled to the first recesses, wherein the first fixing ring comprises a stamped part and a non-stamped part, and the stamped part is thinner than the non-stamped part; and a second fixing ring comprising a plurality of second recesses radially arranged on the second fixing ring, and the second fixing ring being larger than the first fixing ring, wherein another side of each of the blades is coupled to the second recesses, and wherein the first recesses are respectively perpendicular to corresponding tangent lines of the circumferences of the first fixing ring, but the second recesses are not perpendicular to the second fixing ring, and the blades are coupled to the first fixing ring and the second fixing ring with an arc shape.

* * * * *